United States Patent [19]

Tinley

[11] Patent Number: 4,888,572

[45] Date of Patent: Dec. 19, 1989

[54] APPARATUS FOR RELIEVING STRAIN ON ELECTRICAL LEAD

[76] Inventor: Raymond K. Tinley, 319 N. Elmhurst Ave., Mt. Prospect, Ill. 60056

[21] Appl. No.: 274,889

[22] Filed: Nov. 22, 1988

[51] Int. Cl.[4] ..... H01F 15/02; H01F 15/10

[52] U.S. Cl. ..... 336/65; 174/135; 336/192; 439/470

[58] Field of Search ..... 336/105, 65, 192; 174/135; 439/449, 456, 457, 458, 459, 462, 470, 472

[56] References Cited

U.S. PATENT DOCUMENTS

| | | | |
|---|---|---|---|
| 2,473,264 | 6/1949 | Stevens et al. | 174/157 |
| 3,858,160 | 12/1974 | Denton | 439/459 X |
| 4,095,043 | 6/1978 | Martin et al. | 439/459 |
| 4,514,027 | 4/1985 | Seidel | 439/456 |

FOREIGN PATENT DOCUMENTS

| | | | |
|---|---|---|---|
| 502922 | 7/1930 | Fed. Rep. of Germany | 439/459 |
| 564766 | 11/1932 | Fed. Rep. of Germany | 439/456 |
| 1301849 | 8/1969 | Fed. Rep. of Germany | 439/456 |
| 2315409 | 10/1974 | Fed. Rep. of Germany | 174/135 |

OTHER PUBLICATIONS

"Strain Relief Device," IBM Technical Disclosure Bulletin, Martin, vol. 4, No. 5, Oct. 1961, pp. 33, 174–135.

*Primary Examiner*—Thomas J. Kozma

*Attorney, Agent, or Firm*—Kenyon & Kenyon

[57] ABSTRACT

The invention relates to a structure for providing strain relief for electrical leads from transformers, and particularly small transformers and similar electrical devices. The structure includes a boss extending from a base member having a recess therein and a drum portion with a convex surface for extending into said recess and engaging a lead passing therebetween to hold said lead in place. The support structure, in addition to holding said drum portion, also supports the transformer thereon.

7 Claims, 1 Drawing Sheet

APPARATUS FOR RELIEVING STRAIN ON ELECTRICAL LEAD

BACKGROUND AND DISCUSSION OF THE INVENTION

A transformer in many electrical devices is an essential element for converting high voltage, low current electrical energy into higher current, lower voltage for use in a particular electrical device. Transformers typically have electrical leads which bring current into and out of the transformer for use in the remaining portions of the electrical circuit, whatever that may be.

In manufacturing processes often the connection between the electrical lead and the transformer is one of the weaker links in the electrical system. Due to other connections made within the circuitry, there may be some strain imposed on the interface between the lead and the transformer, eventually causing a break in the circuit. It is desirable to have a strain relief of the lead to ensure that such a break does not occur. Often the strain relief mechanisms, if included at all, are located remote from the transformer and require additional steps during manufacture which raises the cost of the circuit.

The invention described herein overcomes many of the problems noted above by employing a structure which not only relieves the strain, but also enhances the manufacturing process. Features of the invention are achieved by a support structure which cooperates with the clamping mechanism and the transformer to simultaneously achieve several goals. This support structure, as will be described in the preferred embodiment, includes posts spaced form one another with a boss located between them and having a recess therein as one part of the clamping mechanism. The other part includes a support plate having a drum portion extending therefrom which is complementary to the recess in the boss. The support plate, in addition to being part of the clamping mechanism, also provides a basis for supporting the transformer thereon such that the assembly steps are substantially reduced and the stress relief mechanism is integral with the support structure for the transformer.

The above has been a brief description of some of the features of applicant's invention and the deficiencies of the prior art. Other features will be readily apparent to those skilled in the art from the detailed description of the preferred embodiment which follows.

DETAILED DESCRIPTION OF THE PREFERRED EMBODIMENT

Figure 1:
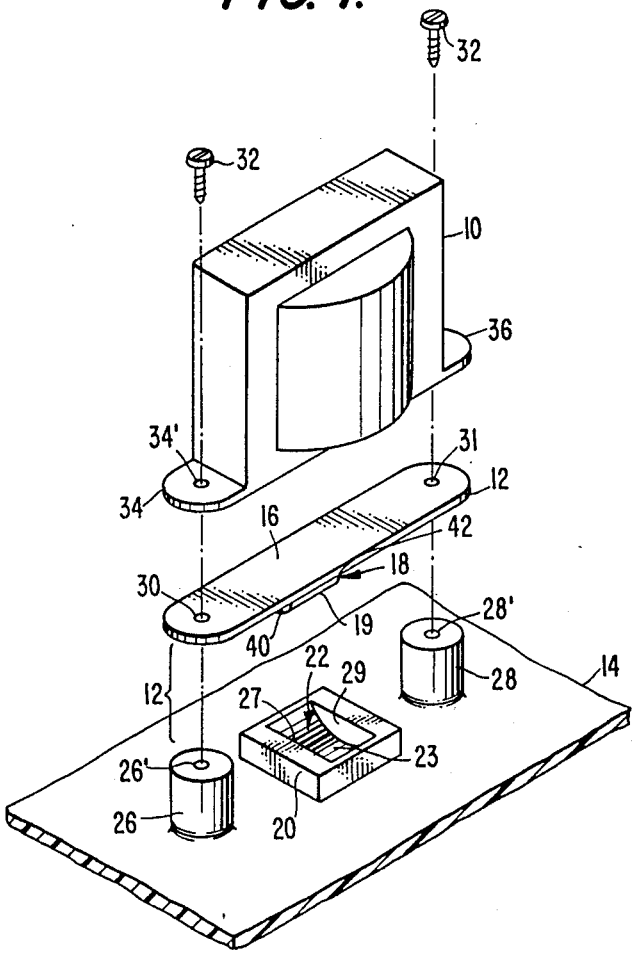
FIG. 1 is a perspective, exploded view of a transformer and other elements of the invention.

As can be seen in FIG. 1, the invention includes the transformer 10, clamp 12 and a base 14, the latter being a portion of a housing for an electric circuit or some other device which requires the use of a transformer. As can better be seen in FIG. 2, the transformer 10 includes leads 24 extending therefrom for connection with other elements of the electronic circuit in a particular housing. The elements of the transformer and the clamp 12 cooperate with the base 14 to fix the transformer thereto and relieve strain on the leads.

The base 14 for this purpose includes two posts 26,28 spaced from one another with holes therethrough for receiving screws. Between posts 26,28 is located a boss 20 with a recess 22 formed therein for receiving part of lead 24. The clamp 12 includes a projection or drum portion 18 which has a convex curved surface 19 corresponding to the curved surface 23 in recess 22. The drum portion 18 is carried by support plate 16 which has a first orifice 30 and a second orifice 31 each having an axis common with that for the holes 26',28' in posts 26 and 28 respectively. In this manner, when plate 12 is placed on posts 26 and 28, the holes 30,31 will register with the holes 26' and 28' for receiving mounting screws therethrough to fix the plate to the posts.

It should be noted that the dimensions of the various elements of the clamp are such that they will engage lead 24 extending between them and hold it in a position that will relieve strain. In this embodiment, curved surface 23 of the recess 22 can be serrated and formed from a curved surface of constant radius of curvature with planar sidewalls 27,29 extended upwardly therefrom as shown. The width between the sidewalls 27 and 29 is slightly larger than the width of leads 24 that will be used to ensure that leads 24 will be properly oriented within recess 22.

Drum portion 18 includes a complementary curved surface 19 which is substantially parallel with curved surface 23 in recess 22. Drum portion also has flat sidewalls 40,42 parallel with those of recess 22, but it has a width between the drum sidewalls 40,42 slightly less than that between the recess sidewalls 27,29 to ensure it will fit within the recess cavity formed by boss 20. By having drum portion 18 extend substantially throughout the recess portion, no part of leads 24 can avoid engagement by the various surfaces of the clamp assembly. Curved surface 19 of drum portion lS can is serrated to ensure that there is sufficient friction when engaged with the surfaces to find the recess to hold the leads in place.

Figure 2:
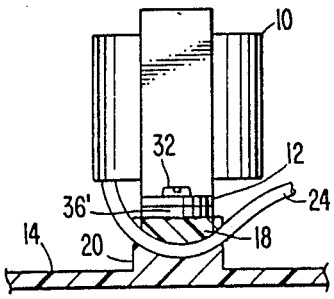
FIG. 2 is a side view of the transformer when fixed to a base portion and the lead in clamped disposition.
Figure 3:
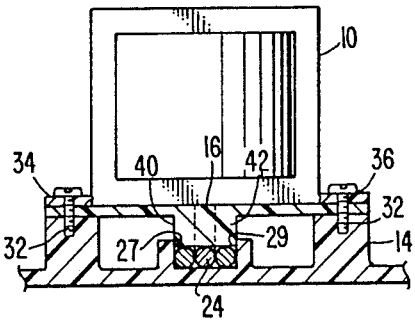
FIG. 3 is a front view of the device as shown in FIG. 2.

It should be noted that the dimensions of the posts 26 and 28, drum portion 18 and the support plate 16 are such that the drum portion 18 does not extend completely into the recess, but remains displaced therefrom sufficiently to permit the leads to pass therethrough, but has a thickness to sufficiently engage the lead to restrain it from movement. As can be seen in FIG. 2, the distance between drum portion 18 and the recess 20 is slightly less than the thickness of the leads to ensure the serrated edges of the various portions of the clamp engage the leads and deform them slightly to hold them in place. These dimensions are chosen to ensure that leads 24 will not be broken or otherwise damaged to detract from its ability to conduct electric current.

The support plate 16 has a generally planar upper surface. The transformer has a planar lower surface with two flanges, a first flange 34 and a second flange 36 extending therefrom. Each flange defines a screw hole 34' and 36' respectively having an axis common with that for the apertures 30 and 31 on the plate and the holes 26' and 28' on the posts. This permits the screws 32 to extend through all the apertures, orifices and holes for securing both the transformer 10 and the plate 12 onto the posts 26 and 28, in a single operation. In this manner, the securing of leads 24 in a strain relieved disposition, as well as securing the transformer to the housing, is accomplished in a single operation. It should also be noted for this purpose that the base may be molded of plastic such that the posts and the boss do not require any fixation and separate operations. Rather, they are formed in the molding process.

Assembly plate 16 is placed under transformer 10 and leads 24 are wrapped under drum portion 18 with flange apertures 34' and 36' registering with holes 30 and 31. This sub-assembly is then placed over base 14 so that leads 24 nest in curved surface 23 and holes 30, 31 and apertures 34',36' line up with corresponding holes 26',28' in posts 26 and 28. Screws 32 are then driven to clamp the leads in place. The leads can then be attached to other elements in the electrical circuit.

The above has been a detailed description of applicant's preferred embodiment. The full scope of invention is more fully defined in the claims which follow and any equivalents thereof. In interpreting the equivalents, the specification should not be construed unduly narrowly to deprive Applicant the full scope of the invention to which it is entitled.

What is claimed is:

1. An electrical element and apparatus relieving strain on electrical leads extending from said electrical element comprising:

(a) a base;

(b) means for supporting said electrical element on said base;

(c) means for fixing said leads relative to said electrical element, said means including a clamp having a first clamp member fixed to said base and second clamp member fixed to said element and having a complementary configuration to said first clamp member for clamping said leads therebetween;

(d) said clamp being located beneath said element when fixed to said base;

(e) said first clamp member being a boss having a recess therein, and said second clamp member including a complementary protrusion having a surface parallel with that of said recess; and (f) said base member including a first post and a second post fixed thereto in spaced relationship, said boss being located between said first and second posts, said protrusion being carried by plate having a first and second plate apertures therein whose centers have axes common with corresponding axes of said posts, and means for securing said plate to said post through said apertures and said clamp with said protrusion extending into said recess for engaging said lead passing therebetween and fixing said lead relative to said electrical element.

2. The electrical element and apparatus of claim 1 wherein said plate is configured to support said electrical element thereon.

3. The electrical element and apparatus according to claim 2 wherein said electrical element is a transformer.

4. The electrical element and apparatus according to claim 3 wherein said transformer includes a first flange and a second flange, with each flange having a hole therethrough, said flange holes having common axes with said aperture of said support member, and said means for securing said support member includes means for securing said flange to said post, said means including screws extending through said flange holes and said plate apertures into said post.

5. The electrical element and apparatus according to claim 4 wherein said protrusion includes serrations for engaging said electrical lead to prohibit movement of said lead between said protrusion and said recess.

6. The electrical element and apparatus according to claim 5 wherein said recess has a width dimension slightly larger than said leads, and said recess having a curved lower surface with a constant radius of curvature said protrusion having a width slightly smaller than that of said recess and said radius of curvature substantially identical to that of said recess, the thickness of said protrusion being less than the depth of said recess for creating a space between said protrusion and said recess when said plate is fixed to said posts, said space being smaller than the thickness of said leads for frictional engagement between said protrusion, said recess and said leads to hold said leads in place.

7. A transformer and apparatus relieving strain in electrical leads from said transformer comprising:

(a) a base, said transformer being fixed to said base;

(b) a first post and a second post extending from said base and spaced from one another;

(c) a clamp for clamping said leads therebetween, said clamp including a first member fixed at said base between said first and second posts, and a second member including a drum portion defining a convex surface with serrations thereon, said first member having a recess with a concave surface having serrations thereon, means for fixing said drum portion to said posts with said drum portion extending into said recess for engaging leads passing between said drum portion and said recess;

(d) raid transformer having a first flange and a second flange extending therefrom, said first flange having a first flange aperture and said second flange having a second flange aperture extending therethrough, a support member for supporting a drum member thereon, said support member having a first support member aperture and a second support member aperture each having a common axis with a corresponding axis of said post, said flange apertures having common axes with corresponding axes of said support member, and screws for extending through said flange apertures and said support apertures into said post for fixing said transformer on said support member and to said posts for engaging said electrical lead to fix said electrical lead relative to said transformer.

* * * * *